United States Patent [19]

Muska

[11] 3,962,881

[45] June 15, 1976

[54] LIQUEFACTION OF A VAPOR UTILIZING REFRIGERATION OF LNG

[75] Inventor: Allen V. Muska, Berkeley Heights, N.J.

[73] Assignee: Airco, Inc., Montvale, N.J.

[22] Filed: Feb. 19, 1974

[21] Appl. No.: 443,596

[52] U.S. Cl. ..... 62/9; 62/40; 62/52; 62/54; 62/121

[51] Int. Cl.[2] ..... F25J 1/00

[58] Field of Search ... 62/54, 20, 36, 37, 40, 45, 50, 51, 54, 55, 21, 9, 52, 53, 122, 121

[56] References Cited

UNITED STATES PATENTS

| | | | |
|---|---|---|---|
| 3,018,632 | 1/1962 | Keith | 62/9 |
| 3,106,071 | 10/1963 | Green et al. | 62/54 |
| 3,183,677 | 5/1965 | Hashemi-Tafreshi | 62/9 |
| 3,191,395 | 6/1965 | Maher et al. | 62/54 |
| 3,243,967 | 4/1966 | Blevins | 62/9 |
| 3,280,575 | 10/1966 | Drake | 62/54 |
| 3,343,374 | 9/1967 | Nelson et al. | 62/40 |
| 3,400,547 | 9/1968 | Williams et al. | 62/9 |
| 3,479,832 | 11/1969 | Sarsten et al. | 62/45 |
| 3,714,790 | 2/1973 | Battey | 62/54 |

*Primary Examiner*—Norman Yudkoff
*Assistant Examiner*—Frank Sever
*Attorney, Agent, or Firm*—David L. Rae; H. Hume Mathews; Edmund W. Bopp

[57] ABSTRACT

Liquefaction of a vapor such as carbon dioxide gas is achieved by utilizing the refrigeration available in liquefied natural gas (LNG) to sub-cool liquid carbon dioxide, which in turn is sprayed into carbon dioxide gas in a condensing vessel thereby liquefying the gas. Suitable control means are provided for maintaining a predetermined temperature within the condensing vessel and for regulating the flow rate of LNG in response to variations in the flow of liquid carbon dioxide before the sub-cooling of liquid $CO_2$ by LNG is effected.

12 Claims, 1 Drawing Figure

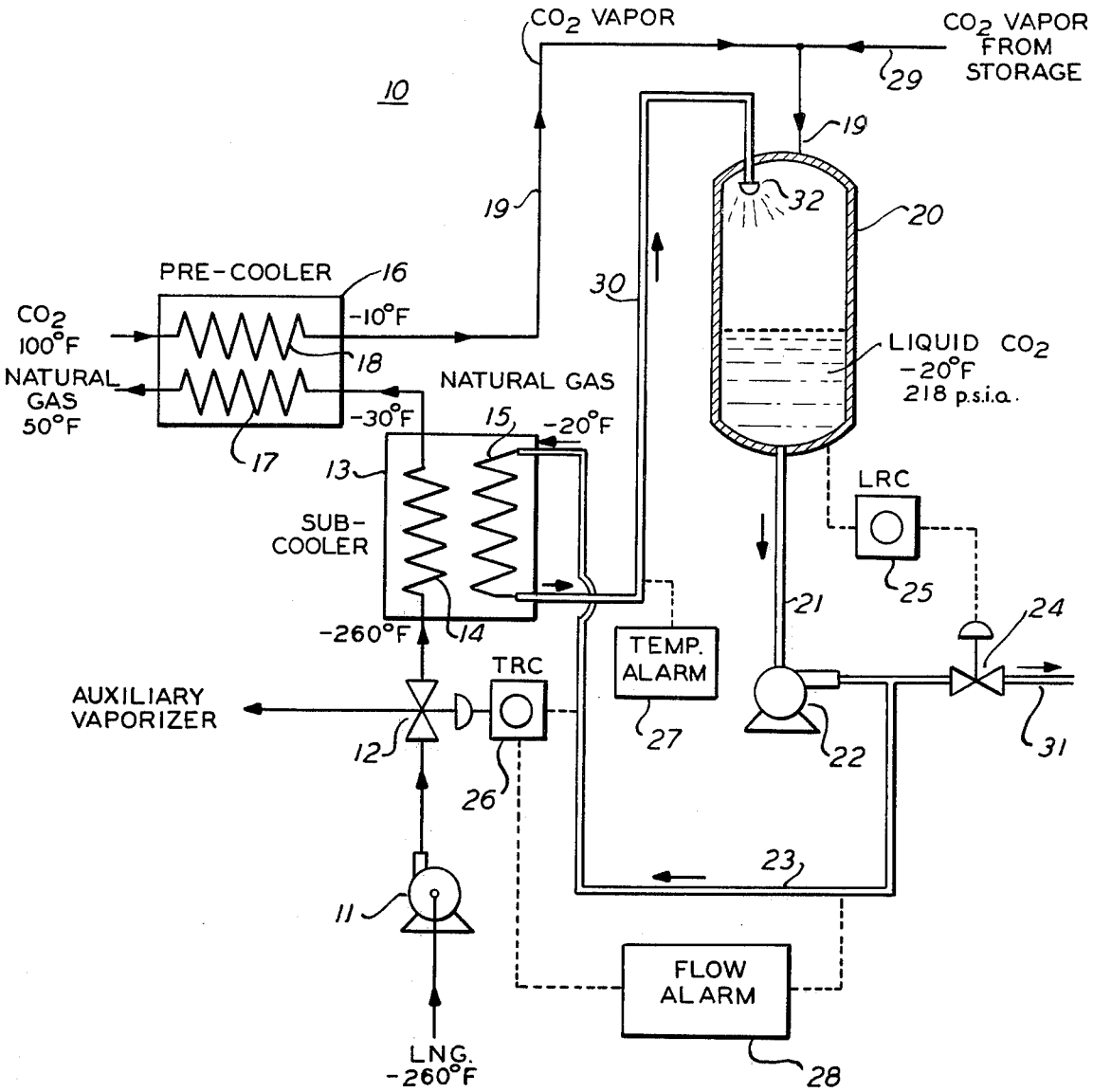
CO2 VAPOR
CO2 VAPOR FROM STORAGE
10
29
19
19
32
20
PRE-COOLER
16
30
CO2 100°F
-10°F
18
LIQUID CO2 -20°F 218 p.s.i.a.
NATURAL GAS 50°F
NATURAL GAS
-30°F
15
-20°F
17
13
LRC
SUB-COOLER
25
21
24
-260°F
14
TEMP. ALARM
TRC
AUXILIARY VAPORIZER
27
22
31
12
26
23
11
FLOW ALARM
LNG. -260°F
28

LIQUEFACTION OF A VAPOR UTILIZING REFRIGERATION OF LNG

BACKGROUND OF THE INVENTION

The present invention relates to the liquefaction of a vapor and, in particular, to the liquefaction of carbon dioxide vapor by the refrigeration contained in liquefied natural gas (LNG).

In numerous instances, it is both physically and economically preferable to transport and distribute materials in liquefied form. This is particularly true, for example, of materials such as carbon dioxide which finds widespread use as a refrigerant in food freezing or chilling processes as well as in the carbonation of beverages. The transportation and distribution of carbon dioxide in liquid form facilitates the handling and storage of this material as liquid carbon dioxide may be readily pumped by means of standard, conventional equipment. In addition, by providing materials such as carbon dioxide in liquid form, the refrigeration content in terms of B.T.U.'s per lb. of material transported renders carbon dioxide economically suitable as a refrigerant. In general, the materials such as carbon dioxide are liquefied by means of conventional cryogenic cycles. It has been found, however, that the equipment required to implement such cycles necessitates substantial capital investments as well as demanding significant amounts of electrical power.

Independent of the foregoing is the fact that in recent years the demand for energy producing natural resources, such as natural gas, has increased sharply. The importation of liquefied natural gas (LNG) from foreign sources is being increasingly relied upon in order to meet this demand. One technique for transporting natural gas is to liquefy the same at the point of production and ship the liquefied product to a particular destination, at which point LNG is vaporized and subsequently supplied to most consumers. In addition, it is common to liquefy pipeline gas during periods of slack or lower demands for electrical energy, i.e. the summer months. In this manner, LNG reserves are developed for periods of greater demand at which time LNG is vaporized so as to be useable as a fuel by electrical generating facilities. In each of the foregoing instances the vaporization of LNG, which is commonly maintained at temperatures of −260°F, provides substantial refrigeration capacity that is all too frequently wasted.

In certain instances, attempts have been made to recover the refrigeration available in liquefied gases. One such attempt is generally described in U.S. Pat. No. 3,154,928 wherein a liquefied gas is used to cool brine in a heat exchanger, thereby assisting in the vaporization of the liquefied gas. Such attempts to recover refrigeration in liquefied gas as, for example, described in the aforementioned reference have not proven particularly effective under conditions wherein a careful temperature control of the cooled or refrigerated material is desirable.

OBJECTS OF THE INVENTION

It is an object of the present invention to provide methods and apparatus for eficiently liquefying a vapor, such as carbon dioxide vapor.

It is also an object of the present invention to provide methods and apparatus for liquefying a vapor wherein capital expenditures and the power requirements of such methods and apparatus are minimized.

It is yet another object of the present invention to provide methods and apparatus for liquefying a vapor utilizing the refrigeration available in LNG in instances wherein the boiling point of the vapor is greater than the boiling point of liquefied natural gas under substantially atmospheric conditions.

It is a further object of the present invention to provide methods and apparatus for liquefying a vapor wherein the utilization of conventional cryogenic equipment is rendered unnecessary.

It it is still a further object of the present invention to provide methods and apparatus for maintaining a vapor liquefaction system in materials balance by controlling the rate of LNG vaporization in response to the flow of, or demand for, the liquefied material.

It is yet another object of the present invention to provide methods and apparatus for liquefying a vapor in a condensing vessel wherein the flow rate of LNG to be vaporized is controlled in order to maintain a predetermined temperature within said vessel.

SUMMARY

In accordance with the present the invention, an exemplary method of condensing the vapor phase of a substance such as carbon dioxide comprises the steps of: providing a supply of the liquid phase of said substance; passing liquefied natural gas in heat eachange relation to said liquid phase to sub-cool the latter; introducing the vapor phase to be liquefied into a condensing vessel; and spraying said sub-cooled liquid phase into said condensing vessel to condense said vapor phase while transforming said sub-cooled liquid phase to said liquid phase.

In order to avoid freezing-up of a sub-cooler or heat exchange device in sub-cooling the liquid phase of the substance, a flow alarm is provided to control the flow rate of LNG to one pass of the sub-cooler in response to the flow rate of the liquid material supplied to another pass of the sub-cooler. Accordingly, should the flow rate of liquid material to the sub-cooler decrease, the LNG flow rate thereto is likewise decreased in order to avoid the aforementioned undesirable freezing effect. In addition, the LNG flow rate is also controlled such that the liquid material within the condensing vessel is maintained at a predetermined temperature. Thus, liquid material which is withdrawn from the condensing vessel and is passed to the sub-cooler, is sub-cooled to an extent necessary to maintain the temperature within the condensing vessel at a predetermined level. This is accomplished by sensing the temperature of the withdrawn liquid material and controlling the flow rate of LNG to the sub-cooler in response to the detected temperature.

BRIEF DESCRIPTION OF THE DRAWING

The invention will be more clearly understood by reference to the following detailed description of an exemplary embodiment thereof in conjunction with the following drawing in which:

The sole FIGURE is a diagrammatic view of exemplary apparatus for utilizing the refrigeration available in LNG for liquefying a material such as carbon dioxide vapor.

DESCRIPTION OF THE PREFERRED EMBODIMENTS

Referring now to the drawing, there is illustrated an exemplary embodiment of apparatus for liquefying a vapor by utilizing the refrigeration of liquefied natural gas (LNG). While the illustrated apparatus is described herein as enabling the liquefaction of carbon dioxide vapor, it will be appreciated that any vapor may be liquefied as long as the boiling point of such vapor is above the boiling point of LNG. Typically, LNG is stored in a suitable cryogenic storage vessel at −260°F at atmospheric pressure. Therefore, vapors such as carbon dioxide, ammonia, freon, etc. which have boiling points above −260°F are vapors suitable for liquefaction by utilization of the illustrated apparatus. However, for the purpose of facilitating a clear understanding of the present invention, reference will be made to the liquefaction of carbon dioxide vapor although as aforesaid other vapors may be utilized by apparatus which generally includes control valves 12 and 24, sub-cooler 13, pre-cooler 16, condensing vessel 20, temperature and flow alarms 27 and 28 and a temperature recording controller 26. A cryogenic pump 11, which may comprise a conventional pumping device suitable for elevating the pressure of a cryogenic liquid such as LNG from substantially atmospheric pressure to a pressure preferably in the rang of 100–600 p.s.i.a. is provided with the inlet thereof in communication with a supply of LNG. Preferably, the supply of LNG is maintained at substantially atmospheric pressure at the equilibrium temperature of −260°F in a suitable cryogenic fluid storage vessel (not shown). It will be understood that the particular pressure of LNG emitted from pump 11 will be determined by the pressure required to effect the desired distribution of vaporized LNG downstream of apparatus 10. In this manner, further compression of natural gas at, for example, an electric generation facility is averted. The outlet of pump 11 is disposed in communication with a control valve 12 which may take the form of a valve device capable of adjustably dividing an influent cryogenic stream between first and second outlets thereof. A first outlet of control valve 12 is coupled to sub-cooler 13 which will be described in greater detail hereafter and the second outlet of valve 12 is disposed to communicate with the inlet of a suitable auxiliary vaporizer (not shown). Accordingly, by appropriate adjustment of control valve 12, the flow of cryogenic fluid supplied therethrough by pump 11 to sub-cooler 13 is regulated.

Sub-cooler 13 preferably comprises a conventional heat exchange device having a first and a second pass therethrough wherein the heat content of a fluid flowing through one pass thereof is efficiently transferred to the fluid flowing through the remaining pass in conformance with conventional operation of heat exchange devices. Thus, LNG at −260°F is supplied through one pass, or coil, 14 while liquid carbon dioxide at, for example, a temperature of −20°F is passed through the other pass, or coil, 15 thereof. A pre-cooler 16, which may comprise a conventional heat exchange device similar to sub-cooler 13 is provided with a first pass 17 and a second pass 18 with the first pass 17 being connected to receive at the inlet thereof the fluid supplied at the outlet of pass 14 of sub-cooler 13. As liquefied or natural gas is supplied through pass elements 14 and 17, each of such elements will hereinafter be referred to as the LNG pass of either sub-cooler 13 or pre-cooler 16, respectively. Pass element 18 of pre-cooler 16 is adapted to receive carbon dioxide vapor at the inlet thereof and to supply such vapor through conduit 19 at a lower temperature as will be described in greater detail hereafter. However, as pass elements 15 and 18 are supplied with liquid and gaseous carbon dioxide, each of such elements will be referred to as the $CO_2$ pass of sub-cooler 13 and pre-cooler 16, respectively.

Condensing vessel 20, which may take the form of any suitably enclosed vessel designed to retain liquid carbon dioxide, at, for example, a temperature of −20°F and at a pressure of 218 p.s.i.a. is provided. To facilitate further handling and distribution of liquid carbon dioxide while enabling liquefaction of carbon dioxide in the most economical manner, the foregoing temperature and pressure of liquid $CO_2$ are preferred. However, it will be realized that other suitable pressure and temperature conditions may be maintained within condensing vessel 20. The thickness of the walls of vessel 20 will, of course, be selected such that pressures on the order of 218 p.s.i.a., or any other desired pressure will be safely withstood. Maintenance of liquid carbon dioxide in condensing vessel 20 at a temperature of −20°F will permit the formation of a major portion of vessel 20 from a material such as carbon steel. However, in order to provide a sufficient safety factor, particularly in view of the introduction of sub-cooled liquid carbon dioxide in spray form to the upper reaches of vessel 20 as will be described in detail hereafter, it is preferable to form at least the upper portion of vessel 20 from a material which will withstand temperatures on the order of −50° to −65°F. For this purpose a suitable nickel steel alloy which may be comprised of approximately 2–¼% nickel may be utilized. Furthermore, it will be appreciated that investment in both condensing vessel 20 and carbon dioxide storage vessels (not shown) may be minimized by reducing the operating pressure of vessel 20. For example, operation at a pressure of approximately 84 p.s.i.a. is feasible by reducing the temperature within vessel 20 to −65°F.

A conduit 21 is disposed in communication between the lower reaches of vessel 20 and the inlet of a pump 22, which may take the form of any conventional device capable of elevating the pressure of a cryogenic liquid supplied thereto. The outlet of pump 22 is disposed in communication with a conduit 23 and through a control valve 24 to a further conduit 31. Conduit 23 is effective to permit the passage of liquid carbon dioxide to the $CO_2$ pass 15 of sub-cooler 13 and conduit 31 is preferably arranged in communication with a suitable storage vessel (not shown) for retaining carbon dioxide liquefied in condensing vessel 20. A liquid recording controller (LRC) 25 which may comprise a known control device capable of detecting a liquid level and producing a control signal in response thereto is coupled between condensing vessel 20 and control valve 24. Controller 25 is thus effective to regulate the level of liquid carbon dioxide within condensing vessel 20 by sensing the level of liquid $CO_2$ therein and controlling the flow of liquid through valve 24 in response thereto. For example, in the event that the level of liquid carbon dioxide within vessel 20 increases above a predetermined value, controller 25 is effective to sense this condition and to cause an adjustment of the setting of control valve 24 by opening the same and thereby increasing the flow therethrough. It will be appreciated that any suitable device capable of the foregoing control operation and any conventional control valve may be utilized as controller 25 and valve 24.

As previously mentioned, liquid carbon dioxide is passed through conduit 31 to a suitable storage vessel (not shown) and in the course of introducing and storing such liquid in a conventional storage vessel, a minor portion of this liquid is inevitably vaporized. Moreover, as illustrated in the drawing, the carbon dioxide vapor which evolves from the filling of a suitable liquid $CO_2$ storage vessel (not shown) may be recovered and supplied through conduit 29 and thence jointly with $CO_2$ vapor supplied through conduit 19 into the upper reaches of condensing vessel 20.

A temperature recording controller (TRC) 26 which may take the form of a known device for effecting an adjustment of a control valve in response to sensing the temperature of a cryogenic fluid, is provided to control the operation of control valve 12 in response to detected variations in the temperature of liquid $CO_2$ supplied through conduit 23 to sub-cooler 13. More particularly, in the event that the temperature of liquid $CO_2$ decreases below a predetermined temperature, e.g. −20°F, control valve 12 is adjusted to decrease the flow of LNG to the LNG pass 14 of sub-cooler 13 thereby increasing the flow of LNG to the auxiliary vaporizer (not shown). In addition, a flow alarm device 28, which may comprise any conventional device capable of producing an output which varies in accordance with a detected flow rate of a fluid, is provided and is preferably coupled to conduit 23 and temperature recording controller 26. Flow alarm device 28 is effective to detect variations in the flow rate of liquid carbon dioxide through conduit 23 and to cause temperature recording controller 26 to adjust control valve 12 thereby regulating the flow of LNG supplied to the LNG pass of sub-cooler 13 in response to the rate at which liquid carbon dioxide is supplied to the $CO_2$ pass 15 of sub-cooler 13. In addition, a temperature alarm 27 which may comprise a conventional indicating device which produces either a visual or audible output signal upon detecting a predetermined temperature is suitably disposed so as to sense the temperature of sub-cooled liquid carbon dioxide flowing through conduit 30. Thus, in the event that the temperature of such sub-cooled liquid $CO_2$ decreases below a predetermined level, e.g. −65°F, an alarm will be activated thereby warning an operator of an undesirable temperature condition.

The operation of the exemplary embodiment of the present invention will now be described. Liquid carbon dioxide which may be initially introduced into and maintained in condensing vessel 20 at a temperature of −20°F and under a pressure of 218 p.s.i.a. is withdrawn therefrom through conduit 21 with at least a portion thereof being supplied through conduit 23 by operation of pump 22. The remaining portion of the liquid carbon dioxide supplied by pump 22 is transferred to a storage vessel (not shown) through a control valve 24 and conduit 31 as previously described. Thus, a portion of the withdrawn liquid $CO_2$ is fed through conduit 23 to the $CO_2$ pass 15 of sub-cooler 13. Concurrently, LNG is pumped through control valve 12 to the LNG pass 14 of sub-cooler 13, thereby reducing the temperature of the liquid carbon dioxide from −20°F to a temperature of the liquid carbon dioxide from −20°F to a temperature preferably between −50° and −60°F. The LNG supplied to sub-cooler 13 is vaporized therein and exits from the LNG pass thereof as natural gas at a temperature of approximately −30°F and is supplied to the LNG pass 17 of pre-cooler 16 and is exited therefrom at a temperature of approximately 50°F. The pre-cooled $CO_2$ vapor is combined with $CO_2$ vapor evolved from a liquid storage vessel (not shown) and supplied through conduit 19, with the total flow of $CO_2$ vapor subsequently introduced into the upper reaches of condensing vessel 20.

The liquid carbon dioxide which is sub-cooled by the vaporization of LNG and is emitted from the $CO_2$ pass 15 of sub-cooler 13 is supplied through conduit 30 and a spray device 32 into the upper reaches of condensing vessel 20. Spray device 32 is effective to produce a fine spray or mist of droplets of sub-cooled liquid carbon dioxide into the $CO_2$ vapor within condenser 20, thereby condensing $CO_2$ vapor and forming a substantially saturated liquid carbon dioxide therein. The purpose, therefore, of spray device 32 is to form small droplets of sub-cooled liquid carbon dioxide thereby enabling intimate contact between such droplets and carbon dioxide vapor within vessel 20. Preferably the droplets exhibit maximum surface area per unit of volume and hence, the smaller the droplet produced, the more intimate is such contact. It will be understood that any spray device 32 capable of providing droplets of liquid carbon dioxide of sizes minute enough to assure effective condensation of the $CO_2$ vapor will be suitable. Thus, in the foregoing manner, carbon dioxide vapor is condensed upon intimate, direct contact with liquid carbon dioxide sub-cooled from the refrigeration available in liquefied natural gas.

As previously mentioned, economical liquefaction of carbon dioxide vapor may be attained by producing liquid carbon dioxide at a predetermined temperature and pressure. Therefore, in order to assure that liquid $CO_2$ is produced at desirable temperature and pressure, e.g. −20°F and 218 p.s.i.a. certain parameters related to the flow of liquid carbon dioxide in the liquefaction apparatus are to be considered. One such parameter to be carefully controlled is the temperature of liquid carbon dioxide produced in condensing vessel 20. Therefore, in order to maintain or regulate such temperature at, for example, −20°F, temperature recording controller 26 is provided to sense the temperature of liquid carbon dioxide prior to the passage thereof through the $CO_2$ pass 15 of sub-cooler 13. Thus, in the event that the temperature of liquid $CO_2$ withdrawn from vessel 20 decreases below −20°F, temperature recording controller 26 senses such a temperature variation and adjusts the division of LNG flow through control valve 12 to cause a decrease in flow through LNG pass 14 of sub-cooler 13 while concurrently increasing the LNG flow to an auxiliary vaporizer (not shown). Thus, with a lower flow rate of LNG through sub-cooler 13, a lesser degree of sub-cooling of liquid carbon dioxide supplied through $CO_2$ pass 15 is effected. Consequently, the sub-cooled liquid carbon dioxide sprayed into vessel 20 causes condensation of $CO_2$ vapor at a somewhat greater temperature, thereby tending to increase the average temperature within vessel 20 to a predetermined level, such as −20°F. In this manner, therefore, the temperature of liquid carbon dioxide in condensing vessel 20 is regulated while the particular temperature to which liquid carbon dioxide is sub-cooled is permitted to vary, for example, between −50°and −60°F.

Another operating parameter of the illustrated apparatus which is to be controlled is the flow rate of liquid carbon dioxide supplied to the $CO_2$ pass 15 of sub-cooler 13. It will be appreciated that in the event of a decrease in the flow rate of liquid carbon dioxide through conduit 23, the possibility of $CO_2$ pass 15 freezing up as a result of an essentially constant refrigeration effect supplied by the LNG pass 14 acting on $CO_2$ pass 15 is likely to occur. In order to avoid an undesirable freezing effect, the flow rate of LNG to the LNG pass 14 is decreased in accordance with the decrease of flow rate of carbon dioxide through conduit 23. Thus, flow alarm 28 is effective to detect a decrease in the flow rate of liquid carbon dioxide thereby causing temperature recording controller 26 to effect an adjustment of control valve 12 such that a greater diversion of LNG to the auxiliary vaporizer (not shown) is effected. The decrease in LNG flow to sub-cooler 13 results in a reduced likelihood or possibility of the $CO_2$ pass 15 freezing up and thereby blocking the flow of sub-cooled liquid $CO_2$ through conduit 30 to condensing vessel 20. Upon restoration of a predetermined flow rate of liquid carbon dioxide through conduit 23, which will be detected by flow alarm 28, temperature recording controller 26 is effective to readjust control valve 12 thereby restoring the desired flow rate through LNG pass 14 of sub-cooler 13.

Although the temperature of natural gas leaving LNG pass 14 of sub-cooler 13 has been described as approximately −30°F, it will be understood that in practice, this temperature will vary in dependence upon the amount of $CO_2$ vapor returned from storage via conduit 29 and 19 to condensing vessel 20 and the overall heat balance of the system. Similarly, the provision of natural gas at 50°F at the exit of LNG pass 17 of pre-cooler 16 is considered exemplary and the particular temperature of natural gas at this point in the system will likewise vary in accordance with previously described factors.

While the present invention has been particularly described in terms of specific embodiments thereof, it will be understood that numerous variations upon the invention are now enabled to those skilled in the art, which variations are yet within the scope of the instant teaching. Accordingly, the present invention is to be broadly construed and limited only by the scope and the spirit of the claims now appended hereto.

What is claimed is:

1. A method of condensing a normally gaseous, cryogenic substance having a boiling point above the boiling point of liquefied natural gas from a vapor phase to a liquid phase comprising the steps of providing said substance in the liquid phase, passing said liquid phase countercurrently in heat exchange relation with liquefied natural gas to sub-cool said liquid phase; introducing the vapor phase of said substance into a condensing vessel; and separately spraying the sub-cooled liquid phase of said substance into said vessel in direct contact with said introduced vapor to condense said vapor to the liquid phase.

2. A method of condensing a substance from the vapor phase as defined in claim 1 additionally comprising the step of: maintaining said liquid phase at a predetermined level in said vessel during condensation of vapor by withdrawing said liquid from said vessel at a rate which varies in accordance with variations in the level of the liquid in said vessel.

3. A method of condensing a substance from a vapor phase as defined in claim 2 wherein the step of passing said liquid phase in said countercurrent heat exchange relation includes supplying at least a portion of said withdrawn liquid phase to one pass of a heat exchange device and supplying liquefied natural gas to another pass of said device thereby subcooling said liquid phase and vaporizing said liquefied natural gas to produce natural gas.

4. A method of condensing a substance from the vapor phase as defined in claim 3 additionally comprising the step of pre-cooling said vapor phase prior to the introduction thereof into said condensing vessel by passing said vapor phase in countercurrent heat exchange relation with said natural gas.

5. A method of condensing a substance from a vapor phase as defined in claim 1 additionally comprising the step of controlling the flow rate of said liquefied natural gas in accordance with the flow rate of said liquid phase supplied in said countercurrent heat exchange relation.

6. A method of condensing a substance from the vapor phase as defined in claim 5 additionally comprising the step of:

regulating the temperature of said liquid phase in said condensing vessel by controlling the flow rate of said liquefied natural gas supplied in said countercurrent heat exchange relation with said liquid phase in accordance with the temperature of said liquid phase.

7. A method of condensing carbon dioxide vapor comprising the steps of:

providing liquid carbon dioxide; passing said liquid $CO_2$ in countercurrent heat exchange relation with liquefied natural gas to sub-cool said liquid carbon dioxide; introducing carbon dioxide vapor into a condensing vessel; and separately spraying said sub-cooled liquid carbon dioxide into said vessel in direct contact with said introduced vapor to condense said vapor to liquid carbon dioxide.

8. A method as defined in claim 7 additionally comprising the step of maintaining liquid carbon dioxide at a predetermined level in said vessel by withdrawing liquid carbon dioxide therefrom at a rate which varies directly with variations in the level of liquid carbon dioxide in said vessel.

9. A method as defined in claim 7 additionally comprising the step of regulating the temperature of said liquid carbon dioxide in said condensing vessel by controlling the flow rate of liquefied natural gas supplied in said countercurrent heat exchange relation with said liquid carbon dioxide in accordance with temperature variations of said liquid carbon dioxide.

10. A method of condensing carbon dioxide vapor as defined in claim 8 wherein said step of passing liquid carbon dioxide in said countercurrent heat exchange relation includes supplying at least a portion of said withdrawn liquid carbon dioxide to one pass of a heat exchange device with supplying liquefied natural gas to another pass of said device thereby sub-cooling said liquid carbon dioxide and vaporizing said liquefied natural gas.

11. A method of condensing carbon dioxide vapor as defined in claim 10 additionally comprising the step of pre-cooling said vapor prior to introducing said vapor into said condensing vessel by passing said vapor in countercurrent heat exchange relation with said previously vaporized natural gas.

12. A method of condensing carbon dioxide vapor as defined in claim 7 additionally comprising the step of controlling the flow rate of liquefied natural gas in accordance with the flow rate of said countercurrent liquid carbon dioxide supplied in said heat exchange relation.

* * * * *